United States Patent [19]

Derby-Lewis

[11] Patent Number: 4,832,309

[45] Date of Patent: May 23, 1989

[54] MOULDING PALLET

[76] Inventor: Gerald Derby-Lewis, Wilderness Motors Buildings, Wilderness, Cape Province, South Africa

[21] Appl. No.: 111,654

[22] Filed: Oct. 23, 1987

[30] Foreign Application Priority Data

Oct. 24, 1986 [ZA] South Africa ..... 86/8091

[51] Int. Cl.[4] ..... B28B 7/22

[52] U.S. Cl. ..... 249/99; 52/828; 249/123; 249/124; 249/135; 249/176; 425/253; 425/DIG. 117

[58] Field of Search ..... 425/253, 255, 452, DIG. 117; 249/60, 98, 99, 119, 122, 123, 124, 125, 135, 176, 177, 188; 52/576, 577, 630, 660, 664, 674, 732, 602, 795, 814, 189, 827, 828, 732

[56] References Cited

U.S. PATENT DOCUMENTS

| | | | |
|---|---|---|---|
| 23,877 | 5/1859 | Worthen | 52/674 |
| 1,481,473 | 1/1924 | Larson | 249/132 |
| 2,022,255 | 11/1935 | Scott | 52/630 |
| 3,481,643 | 12/1969 | Campbell | 52/814 |
| 3,496,691 | 2/1970 | Seaburg et al. | 52/674 |
| 4,693,047 | 9/1987 | Menchetti | 52/664 |

FOREIGN PATENT DOCUMENTS

| | | | |
|---|---|---|---|
| 527976 | 4/1954 | Belgium | 52/630 |
| 988034 | 8/1951 | France | 52/674 |

*Primary Examiner*—Jay H. Woo
*Assistant Examiner*—James C. Housel
*Attorney, Agent, or Firm*—Birch, Stewart, Kolasch & Birch

[57] ABSTRACT

A moulding pallet for moulding building blocks with interlocking surfaces comprises a metal sheet bent to form parallel ridges and valleys, with transverse sheet metal channels inserted through openings in the ridge sides forming transverse secondary ridges.

8 Claims, 2 Drawing Sheets

MOULDING PALLET

INTRODUCTION TO THE INVENTION

This invention relates to a pallet for the moulding of building elements.

Numerous building elements exist which have interlocking fórmations on the top and bottom surfaces for locating the blocks relative to each other during building.

It can be difficult to mould a large number of these blocks at a time. With the use of large capacity block machines, the moulds and pallets have to be able to withstand considerable weight, without distorting or becoming misshapen with time.

Moulds of wood and fibreglass are generally not sufficiently durable for large production machines, and metal castings are too expensive and cumbersome. The shaping of metal by drawing requires a thick and ductile metal which excludes the use of steel.

OBJECTS OF THE INVENTION

It is an object of this invention to provide a moulding pallet which will alleviate the abovementioned difficulties.

SUMMARY OF THE INVENTION

In accordance with this invention there is provided a moulding pallet adapted for use with mould sides for moulding interlockable surfaces in a plurality of building elements, said moulding pallet comprising metal sheeting formed into approximately parallel ridges and valleys, the walls of successive valleys having corresponding openings defining a series of transverse pathways spaced apart along the length of the ridges, the pathways having sheet metal inserts running therethrough and forming secondary ridges.

Preferably the secondary inserts and the sheeting are formed by a bending process, and preferably the metal is steel.

There is provided for the sides of the ridges and secondary ridges to diverge slightly outwardly from each other towards the valleys, and for there to be a plurality of sections of metal sheeting to be held edge to edge by inserts extending through co-axial pathways in the sections.

The adjoining edges of two sections may abut each other intermediate to the side edges of a ridge, and preferably the edges abut each other along the centre of a ridge.

There is provided for there to be three adjoining metal sections.

Preferably the ridges and valleys have flat tops.

The invention extends to a metal sheeting as well as the secondary ridge inserts as separate items, and to a metal sheeting blank for bending into shape for use in accordance with the invention.

BRIEF DESCRIPTION OF THE DRAWINGS

Preferred embodiments of the invention are described below by way of example only, and with reference to the accompanying drawings, in which.

DETAILED DESCRIPTION OF THE DRAWINGS

Figure 2:
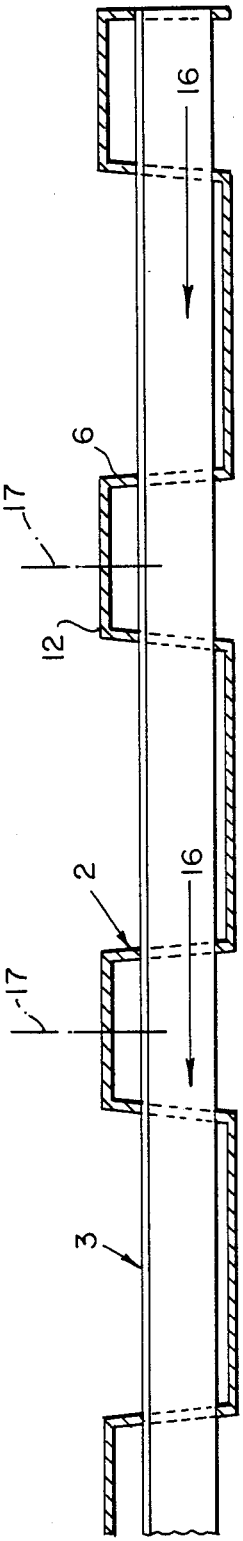
FIG. 2 is a cross-sectional view along lines AA of FIG. 3.
Figure 3:
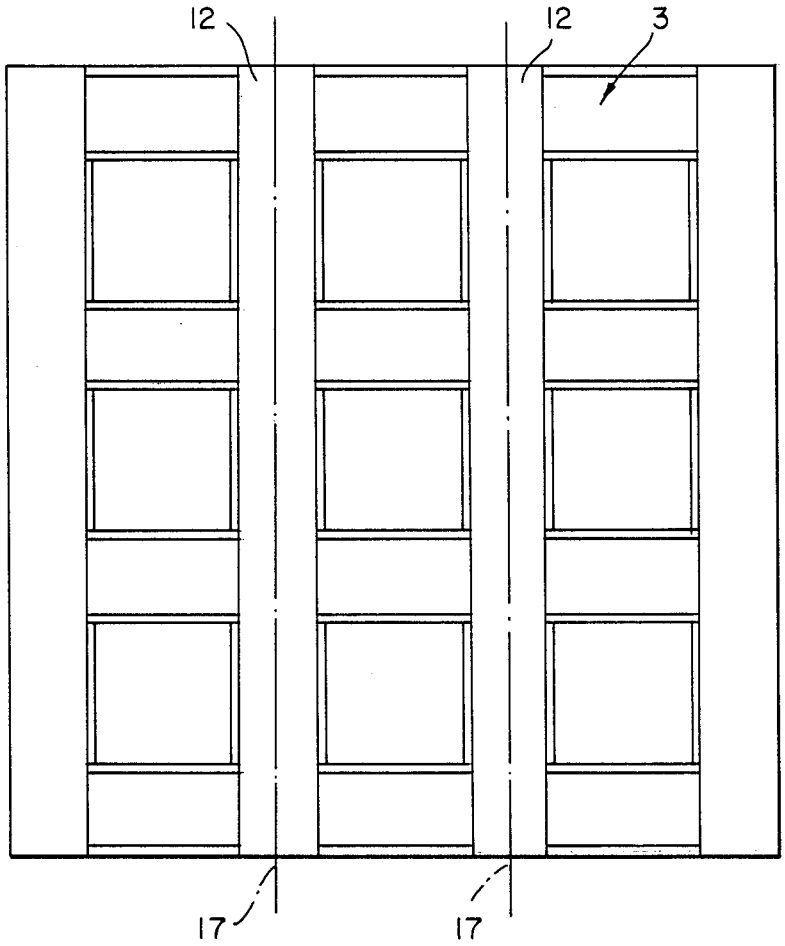
FIG. 3 is a plan view of a moulding pallet according to the invention.

Referring to the drawings, a sheet of metal (1) forms a blank for a major component of a metal pallet, having ridges (2) and valleys (3) formed parallel and alternately, as shown in FIGS. 2 and 3.

The blank has parallel spaced apart bending lines (4) and (5) forming the bottom folds of walls (6) of a valley, and the top of the ridge is formed by similar bends along spaced apart lines (10) at the top of each of the walls (6), to leave a top (12) to the ridge. In between each successive fold (4) and (5) lies a valley (3).

A series of pathways (16) are created through the ridges by the location of openings (18) in line through each of the walls of the valleys along the pathway. The pathways run transversely to the ridges and are spaced apart equally therealong. The openings are generally rectangular cutouts in the metal having their bottoms in line with the bottom of the valley, and the tops (20) stopping short of the top (10) of the walls.

Channel shaped inserts (22) are provided to be inserted through the pathways, and are formed by sheet metal bent into a channel shape, with a slightly inclined side, shown in cross-section (23). The inserts fit neatly into the openings (18) which have sides angled to take the inclination of the channel sides. The free edges of the channel walls rest on the upper valley surface with the top of the channel shapes being underneath the top of the ridges and forming secondary ridges running transversely to the ridges (12).

Figure 1B:
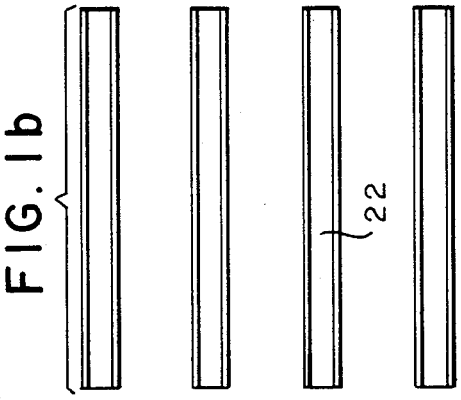
FIG. 1*b* illustrates the channel shaped inserts.
Figure 1A:
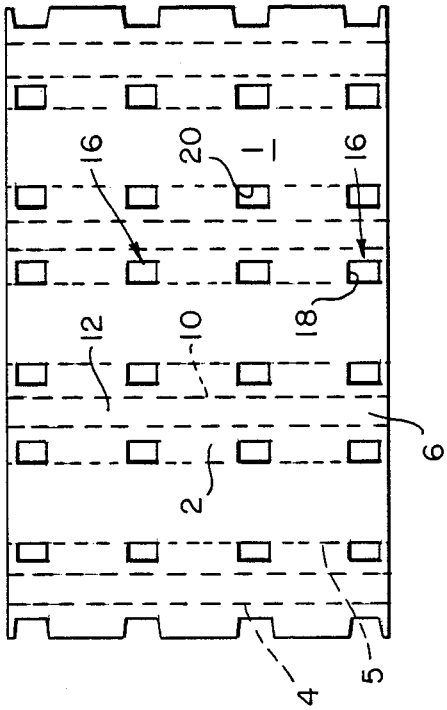
FIG. 1*a* is a plan view of a metal sheeting blank.
Figure 1C:
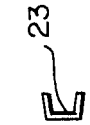
FIG. 1*c* is a cross sectional view of a channel shaped insert.

The major component is bent to form the valleys and ridges as described, and the inserts slid into the pathways to form the secondary ridges. This position is shown in FIGS. 2 and 3 where like numerals indicate like items as described with reference to FIG. 1.

Alternatively, the major component can be made up of several bent sections placed edge to edge and held by the inserts. The abutting edges of three such sections are shown in dotted lines 17 in FIG. 2 and 3. This allows for narrower sections of metal sheeting for bending.

In use, the pallet forms the bottom of a mould and sides are placed around the pallet and over it, to demarcate the sides of blocks to be formed.

It is considered that the invention allows for a relatively thin walled steel sheeting to be used in a simple workshop manufacturing method to form the moulding pallet of requisite strength. The ridges and transverse ridge inserts provide particular rigidity to the structure, and allow for the pallet to provide a surface for a multiplicity of building elements to be moulded, having interlocking ridges and valleys following the pattern of the pallet.

What I claim as new and desire to secure by Letters Patent is:

1. A moulding pallet adapted for use with mould sides for moulding interlockable surfaces in a plurality of building elements, said moulding pallet comprising metal sheeting formed into approximately parallel ridges and valleys, each of said valleys having a bottom and said ridges and valleys being connected by walls therebetween, said walls having corresponding openings defining a series of transverse pathways spaced apart along the length of said ridges, said pathways having channel shaped sheet metal inserts running therethrough and forming secondary ridges having sides which extend from said valley bottoms.

2. A pallet as claimed in claim 1 in which said metal sheeting and said metal inserts are steel.

3. A pallet as claimed in claim 1 in which said walls and said sides of said secondary ridges diverge slightly outwardly from each other towards said valley bottoms.

4. A pallet as claimed in claim 1 or claim 3 in which all said ridges and said secondary ridges have flat tops and all said valley bottoms are flat.

5. A pallet as claimed in claim 1 wherein said metal sheeting comprises a plurality of sections having aligned pathways and held edge to edge by said inserts extending through said aligned pathways.

6. A pallet as claimed in claim 5 in which the edges of two sections abut each other intermediate to said walls.

7. A pallet as claimed in claim 6 in which the edges abut each other along a longitudinal division of the width of a ridge.

8. A pallet as claimed in claim 5 or claim 7 in which there are three adjoining metal sections.

* * * * *